United States Patent [19]

McKee

[11] 3,965,558

[45] June 29, 1976

[54] WIRE TERMINATION APPARATUS

[75] Inventor: William H. McKee, West Covina, Calif.

[73] Assignee: TRW Inc., Elk Grove Village, Ill.

[22] Filed: June 12, 1975

[21] Appl. No.: 586,453

Related U.S. Application Data

[63] Continuation of Ser. No. 502,085, Aug. 30, 1974, abandoned.

[52] U.S. Cl. ..... 29/203 MW; 29/203 DT; 29/203 HT; 29/628

[51] Int. Cl.[2] ..... H01R 43/04

[58] Field of Search ... 29/203 MW, 203 DT, 203 D, 29/203 HT, 203 HC, 203 P, 628

[56] References Cited

UNITED STATES PATENTS 3,758,935 9/1973 Long et al. ..... 29/203 MW 3,886,641 6/1975 Davis ..... 29/203 MW

*Primary Examiner*—Carl E. Hall

*Attorney, Agent, or Firm*—Neuman, Williams Anderson & Olson

[57] ABSTRACT

Apparatus for forming solderless terminations in a connector is provided which trims the wires to be terminated and locates the trimmed wires in precise predetermined parallel spaced positions. An adapter having a connector mounted therein is movable into desired aligned relationship with the wires, with the connector positioned beneath the wire ends. The adapter then elevates the connector relative to the wires so that the positioned wires are received between ribs defining wire-receiving channels in the connector. The wires are then driven between the channel-defining ribs into engagement with wire-gripping jaws of solderless terminals located between the ribs.

15 Claims, 10 Drawing Figures

2
2
10
12
14
16
18
20
22
23
24
26
28
30
31
32
34
35
36
40
41
42
44
44
46
62
64
67
67a
67b
90
92
94
96
98a
100
102
104
106
106a
107

FIG. 2
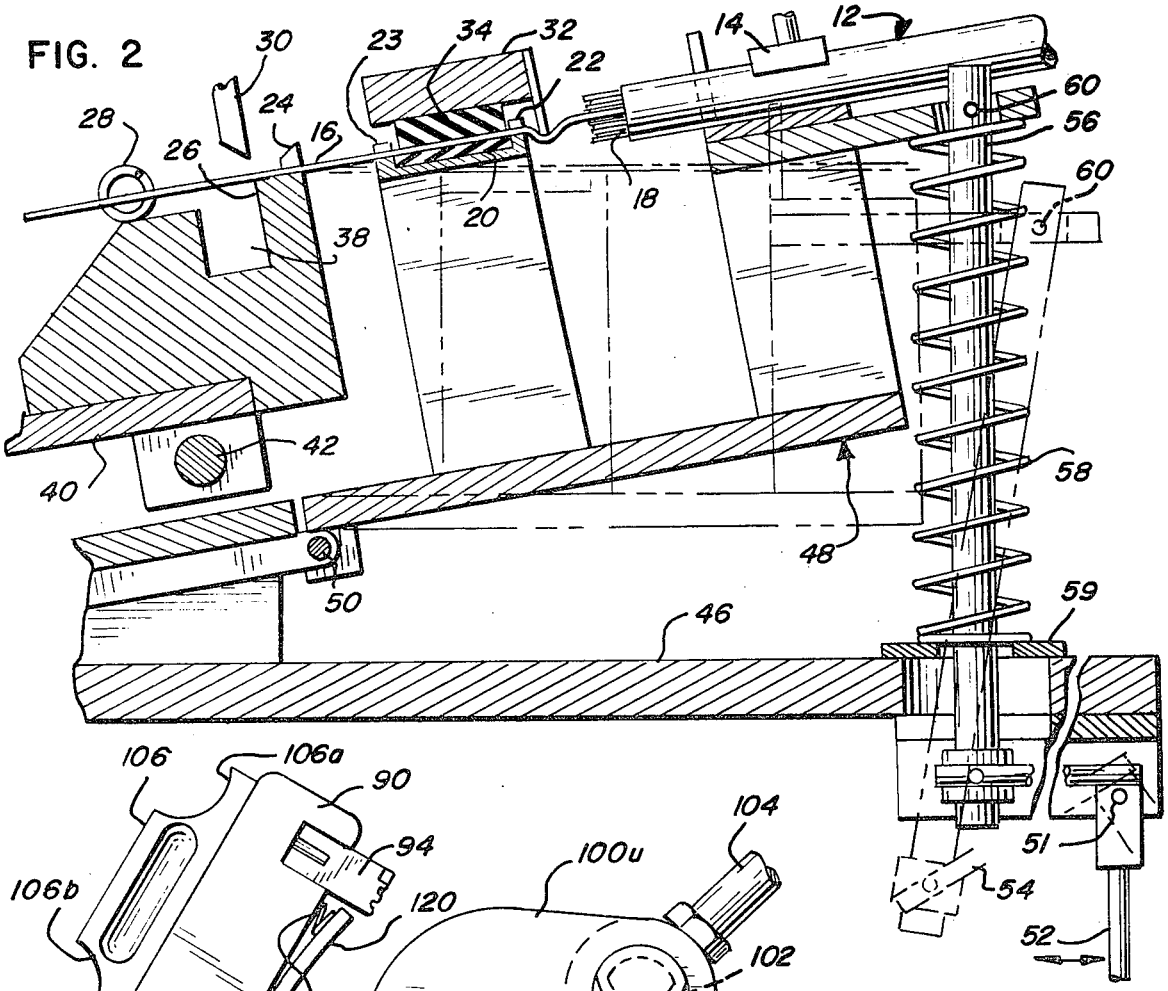
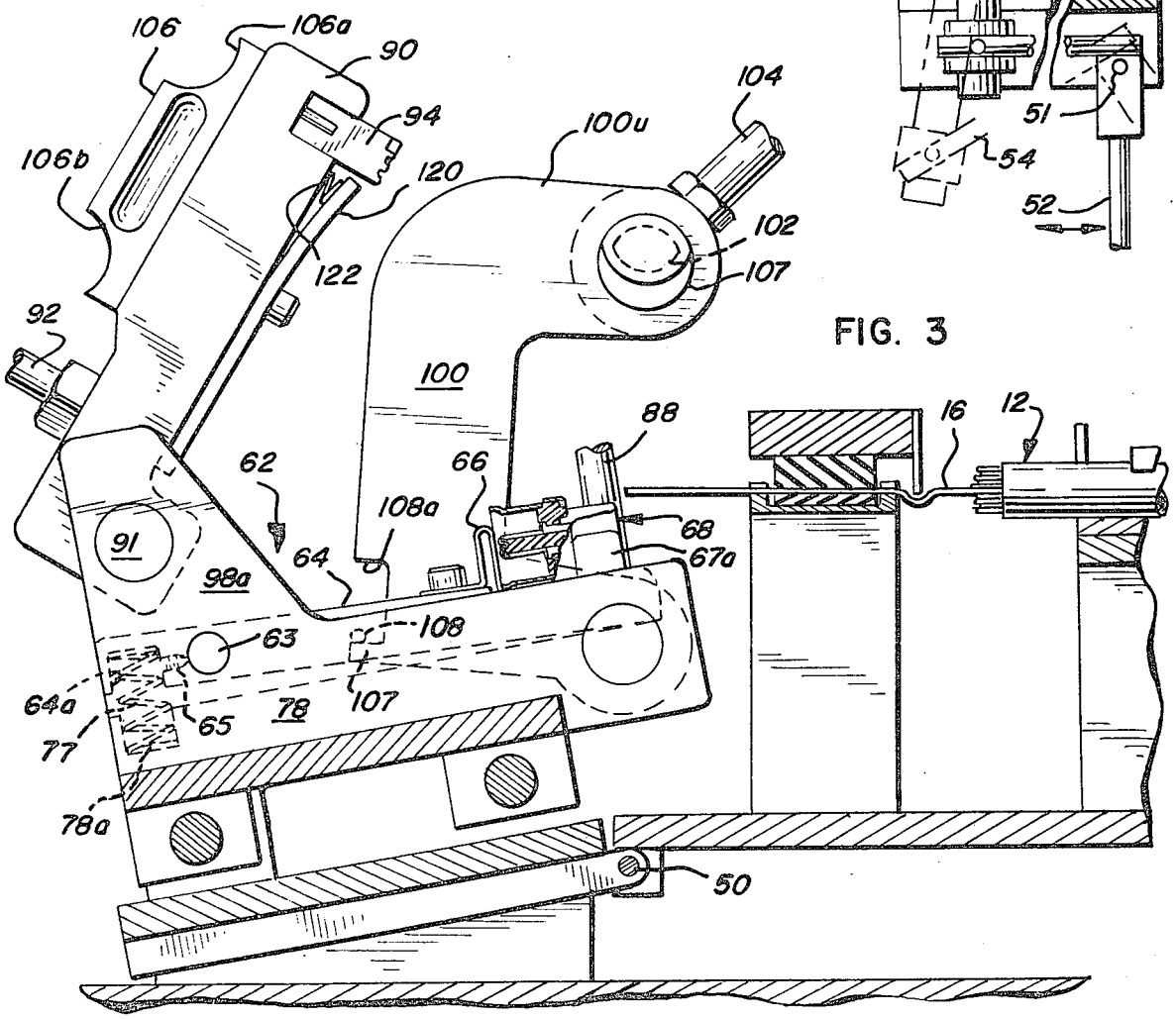
FIG. 3

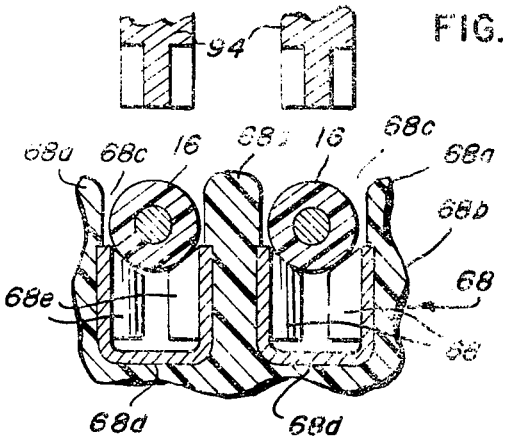
FIG. 9
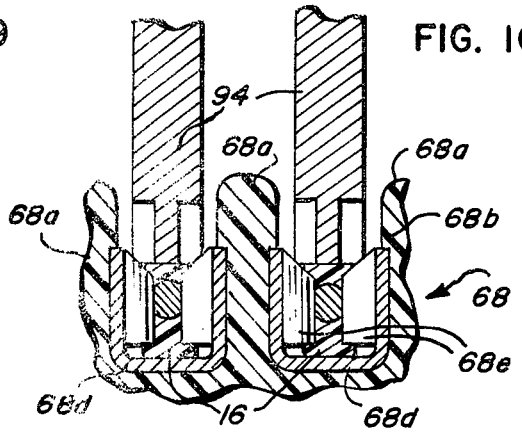
FIG. 10
FIG. 8
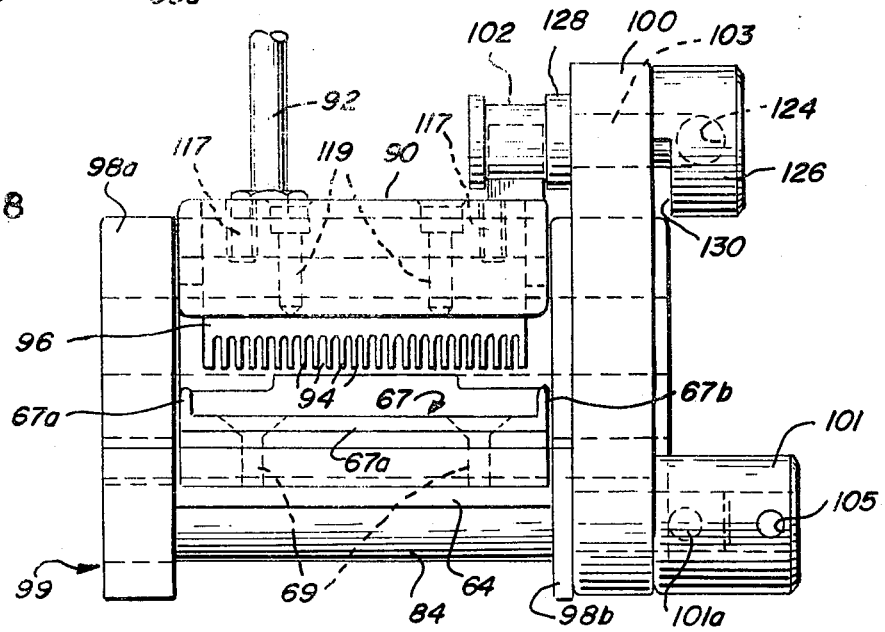
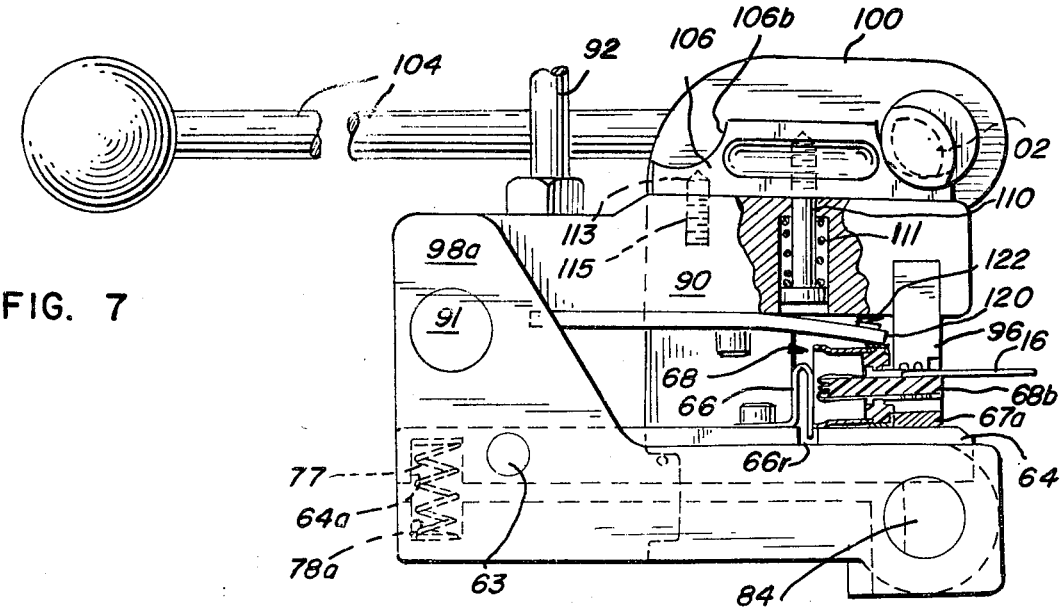
FIG. 7

WIRE TERMINATION APPARATUS

This is a continuation of application Ser. No. 502,085 filed Aug. 30, 1974 now abandoned.

This invention relates to the formation of solderless wire terminations and more particularly to adapting apparatus previously employed in the formation of soldered terminations in multi-wire connectors to facilitate the formation of solderless terminations in multi-wire connectors.

Connectors adapted to connect a plurality of wires have, of course, been in widespread use for many years in innumerable industrial and domestic applications. The communications industry alone has employed countless multi-wire connectors for many years. Earlier multi-wire connectors of the prior art employed soldered connections in which each wire was soldered to a metal contact piece of the connector in a step which required both time and care to assure a desired, secure wire termination in the connector. One device employed in soldered connections is a machine manufactured by Warren Machine Company, Inc. of Westbury, New York and identified as Model No. WS-25 interconnect wire stripping and assembly machine. That prior machine is referred to hereinafter simply as the "Warren machine."

In recent years numerous forms of solderless connectors have been developed and gained wide usage. Recent developments in solderless connectors are many and include connectors of the type disclosed in my co-pending U.S. Ser. No. 443,678 filed Feb. 19, 1974, which is directed to a solderless termination system employing wire-engaging blades or jaws in the terminals which function to both pierce the wire insulation and grip the inner conductor so as to assure a desired electrical contact. My co-pending U.S. Ser. No. 443,730, filed Feb. 19, 1974, is directed to a wire terminating system which employs a wire-restraining device providing a strain relief means forming an integral part of the terminal in which disposed. My co-pending U.S. Ser. No. 502,086 filed Aug. 30, 1974, now abandoned disclosed apparatus for forming terminations in such connectors.

It is an object of this invention to provide improved apparatus for the efficient formation of solderless terminations in multi-wire connectors.

It is a more specific object of this invention to facilitate modification of existing Warren machines for the formation of solderless terminations in multi-wire connectors.

It is another object of this invention to provide an adapter for simple and economical conversion of known soldering apparatus of the prior art to use in making solderless terminations.

It is another object of this invention to provide an adapter for use in the formation of solderless terminations which is readily adaptable for use with a variety of solderless connectors.

The above and other objects and advantages of this invention will be apparent from the following detailed description when read in the light of the appended claims and accompanying drawings.

In one exemplary embodiment of this invention apparatus is provided for simultaneously terminating a number of wires in multi-wire connectors of the type having solderless terminals for individual wires located in channel-shaped recesses between parallel spaced ribs of the connectors. The apparatus includes means for trimming the wires and positioning the trimmed end portions of the wires in predetermined parallel spaced positions. These operations may be carried out in substantially the same manner as in the prior Warren machines. A connector then is mounted in a holder, and the wire end portions and holder are positioned such that the terminal recesses of the connector are in juxtaposed registry with the trimmed wire end portions. These end portions then are postioned between the ribs of the connector, by relative movement between the holder and the end portions laterally of the longitudinal axes of the wires. A plurality of rams then is driven into the recesses, also in a direction laterally of the wire axes, to engage and drive the wire end portions into the respective terminals in the connector recesses to effect the terminations.

For a more complete understanding of this invention reference should now be had to the embodiment illustrated in greater detail in the accompanying drawings and described below by way of an example of the invention. In the drawings:

FIG. 2 is a sectional view taken generally along line 2—2 of FIG. 1 and illustrating the apparatus as the wires to be terminated in a multi-wire connector are being trimmed;

FIG. 3 is a sectional view of the apparatus of FIG. 1, with the connector holder shown in side elevational view at the wire insertion position, and with a connector in the holder, the ram plate in an elevated position and the wire holder retracted;

FIG. 7 is a view similar to FIG. 6 with the ram plate fully seated, and further illustrating the adjustable bearing pad employed on the ram plate;

FIG. 8 is a front elevational view of the connector holder-adapter as in FIG. 7, with the connector removed;

FIG. 9 is a fragmentary sectional view illustrative of the relationship of the wires and connector just prior to the seating of the wires in the terminals; and FIG. 10 is a view similar to FIG. 9 after the wires have been driven into the terminals by the ram blades of the provided adapter as in FIG. 7.

Figure 1:
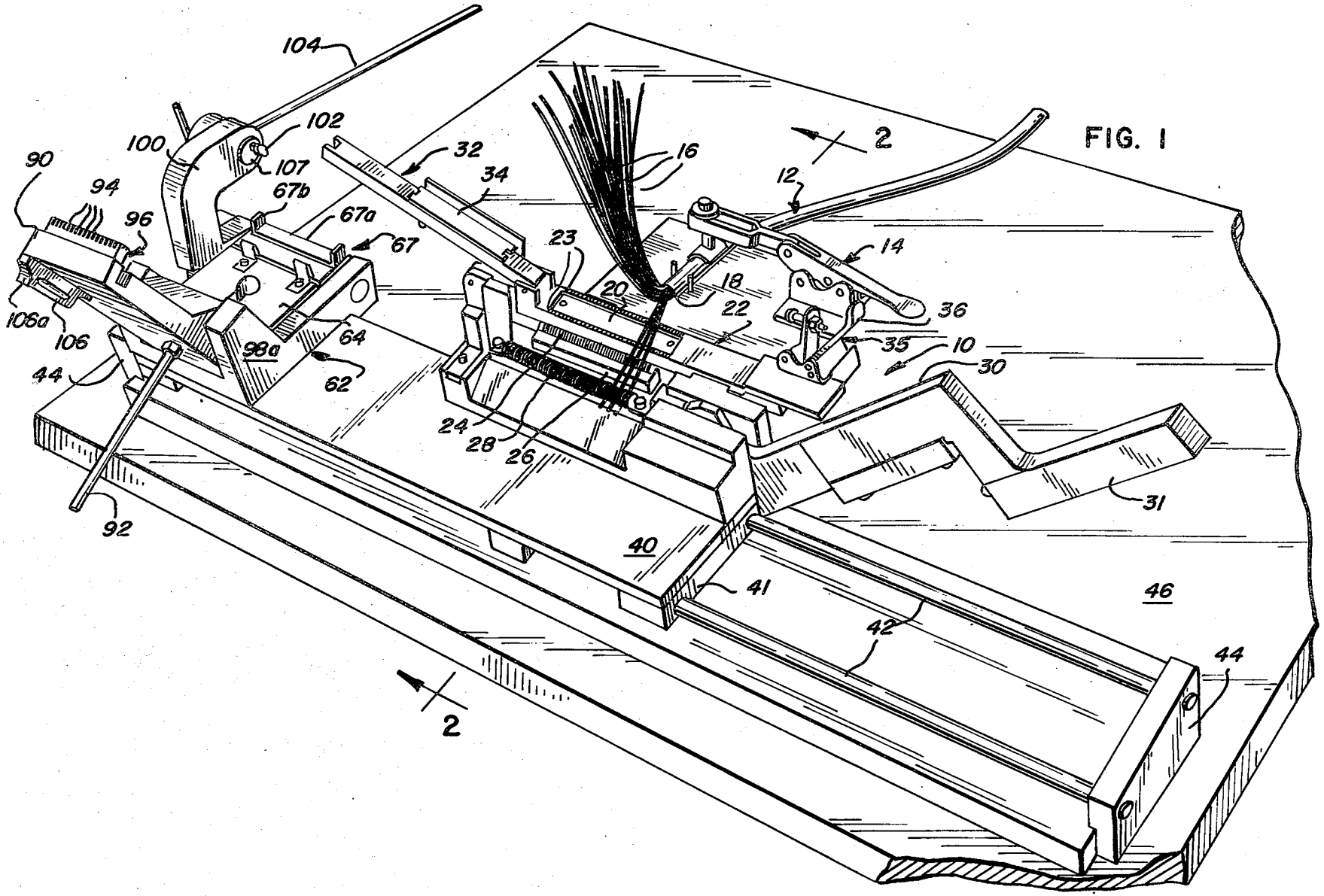
FIG. 1 is a perspective view of a wire termination apparatus employing teachings of this invention.

Referring now more particularly to FIG. 1, machine 10 is a modified version of the aforementioned Warren machine. Such Warren machines previously were employed in the stripping and assembling of wires for soldered terminations in cable connectors. The "WS-25" Warren machine was particularly designed for stripping and inserting wires, 25 at a time, in multi-terminal connectors commonly used with communication cable including 25 pairs of wires. Such a cable is shown at 12 disposed in fixed position on machine 10 by means of a toggle-actuated cable clamp 14. A plurality of wires 16 extend from end portion 18 of the cable beyond which the outer cable insulation sheath has been severed and removed in the usual manner. Each of the wires 16 includes a conductor and an insulation covering which is color-coded for ease of identification, such as in effecting proper arrangement relative to numbered connector terminals.

The components 20 through 60 of the illustrated machine 10 generally correspond to components of the prior Warren machines, and will be referred to herein only briefly and as necessary to describe the preferred embodiment of this invention.

With a cable 12 clamped in position on a machine 10 as in FIG. 1, the operator selects the wires 16 in desired order and threads each wire from the cable portion over a resilient base pad 20 of wire clamp 22, between the serrations of serrated ribs 23 at each side of the pad 20, then between the teeth of a wire-positioning comb 24, over the edge of a shear plate at 26, and between the coils of a retention spring 28. The spring 28 serves to retain the wires in position until completion of the step of cutting the wires to length. Although only a few wires are illustrated in the threaded position in FIG. 1, all of the wires to be terminated in one side of a connector 68 (which wires may be 25 in number) are arranged over the clamp base, comb, shear plate and retention spring in the same manner as the threaded wires of FIG. 1 and in parallel spaced relation to one another as determined by the spacing of the serrations of ribs 23 and the teeth of the comb 24. Following the proper threading or "stringing out" of all of the cable wires for one side of a connector, a pivoted upper clamp bar 32 having a resilient clamp pad 34 is placed in overlying relation with the resilient base pad 20. Toggle lock 35 securely clamps bar 32 to the base of clamp 22 by pivoting handle 36 downwardly to securely grip the parallel wires 16 sandwiched between the pads 20 and 34. Blade 30 then is pivoted downwardly by handle 31 and passes in adjacent shearing relation with plate 26 as it enters cavity 38, as seen in FIG. 2. Thus, all the threaded wires 16 are trimmed to a uniform desired length.

It will be seen in FIGS. 1 and 2 that the shear plate 26, comb 24 retention spring 28 and shear blade 30 are mounted on a sliding platform plate 40 slidably movable on parallel rods 42. These rods are fixedly mounted in opposed side plates 44 which plates rest on table top 46.

As will also be seen from FIG. 2, the clamp assembly 22 in which the trimmed wires 16 are clamped comprises part of a pivoting assembly 48 which pivots about rod 50. A bell crank lever is pivoted at 51 and includes an arm 52 which is acutated by a foot treadle (not illustrated) and, when actuated, causes arm 54 to pivot downwardly thereby moving a spring-loaded rod 56 downwardly against the upwardly biasing action of coil spring 58 which rests on bearing washer 59. Because of a pivot pin connection at 60, downward movement of rod 56 pivots assembly 48 downwardly into the broken line position of FIG. 2 and thereby retracts the cut wires held in clamp 22 into a substantially horizontal retracted position wherein the parallel wire ends are clear of the sliding mechanism on rods 42, as also indicated by the broken lines in FIG. 2.

After the wires 16 have been trimmed to desired length, and retracted with assembly 48, blade 30 is raised by handle 31. Plate 40 is then slidably moved to the right as viewed in FIG. 1 to move the cutting blade 30, shear plate 26, comb 24 and retention spring 28 mounted thereon away from the trimmed wires 16.

The trimming apparatus and operation of machine 10 differ from the prior Warren machines in that the prior machines included means actuated with the trimming blades to sever and strip the insulation from the end portions of the trimmed wires during the trimming and retraction operations. In the present machine 10, the wires simply are severed at the outer edge of sheer plate 26 with the insulation remaining on the parallel end portions which extend cantilever fashion from the clamp 22.

Also, in the prior machines a connector holder moved a connector into alignment with the wires as the plate was moved to the right. Advancement of the wire holder assembly then moved the stripped wire ends directly into their final positions in terminal soldering channels in the connector by an essentially endwise or axial movement of the wires. Such a manner of entry of the wires was found to be unworkable for effecting solderless terminations.

In the machine 10, a unique connector holder or adapter 62 is mounted on the plate 40, i.e., the left end as viewed in FIG. 1. Movement of the plate unit to the right as described thus moves the holder 62 and a connector 68 therein to a position in alignment with the trimmed wires as seen in FIG. 3. An adjustable stop may be disposed on rods 42 to precisely locate the adapter and connector thereon relative to the overlying wires, or platform end support 41 may abut an adjustable stop (not shown) on side plate 44 (see FIG. 1) so as to serve as a stop to precisely position the adapter 62 relative to the wires 16, for registry of the wires and the terminal recesses of the connector.

Figure 4:
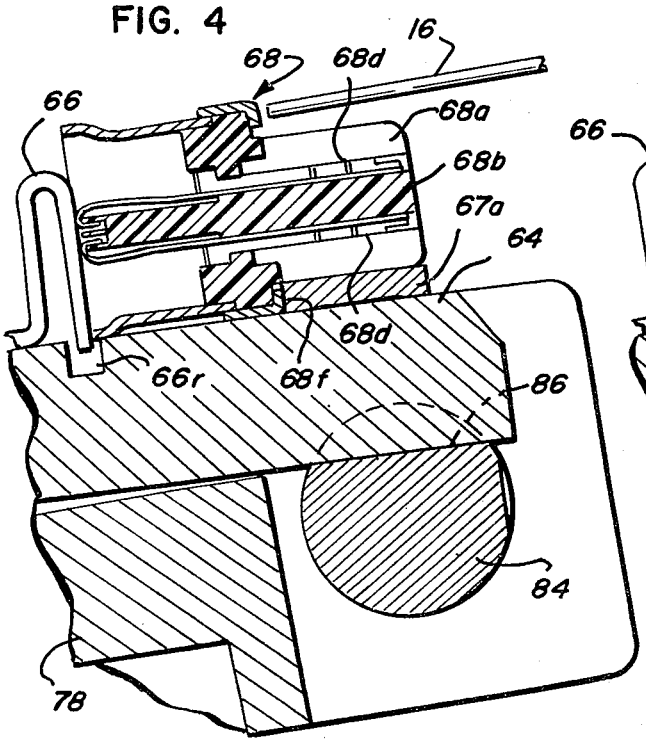
FIG. 4 is a partial sectional view of the connector and holder of FIG. 3 with the wires advanced into their alignment positions.

Assembly 48 then is permitted to move forward to position the wires over the connector 68 as in FIG. 4. At this point, each wire is positioned directly over and in registry with the terminal recess of the connector 68 in which the respective wire is to be terminated. It should be noted that the connector 68 includes a plurality of spaced parallel ribs **68*a* in the terminal block portion 68*b*, each adjacent pair of ribs defining a channel-shaped terminal recess 68*c*, see FIGS. 4–6, 9 and 10. One side of each of the recesses is open through one side of the terminal block and one end of each of the recesses is open through the end of the terminal block. Such ribs and recesses are provided in two opposed rows on opposite sides of the block 68*b*. A terminal having a channel-shaped terminal body 68*d* such as disclosed in my aforementioned applications is located in the bottom of each recess, see FIGS. 4, 5, 9 and 10. Each of these terminal bodies has an open side and an open end aligned with the open side and open end of the recess, and includes side jaws 68*e* which rupture the insulation of the respective wire and establish electrical contact with the conductor core as the wire is forced laterally of its axis into the terminal 68*d***.

Figure 5:
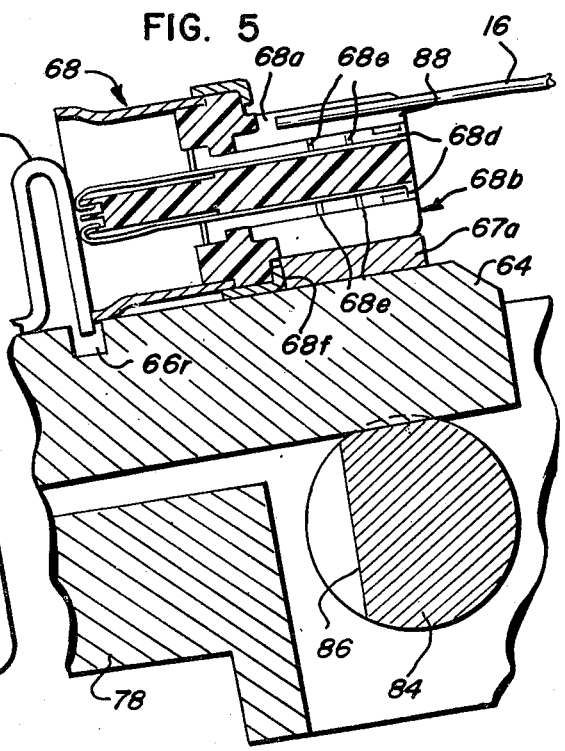
FIG. 5 is a fragmentary sectional view corresponding to FIG. 4, with the connector mounting plate in a raised position to position the wires between the ribs of the connector.

Referring now particularly to FIGS. 3–8, the holder 62 includes a floating connector mounting plate 64 attached to a pivot shaft 63 by set screws 65. The plate 64 carries a pair of spring clips 66 and a connector locator element 67 for precisely positioning a connector such as connector 68 illustrated in FIGS. 4 through 6 on the plate. Screws 69 may secure locator 67 to plate 64 (see FIG. 8). The connector locator element 67 includes a center rib section **67*a* extending across the forward end of plate 64, parallel to rods 42 and to clamp 22, and upstanding parallel end posts 67*b* and 67*c* at opposite ends of the section 67*a*. The element 67 is dimensioned to closely engage the opposite ends of the terminal block portion 68***b* of a connector 68, preferably with a snug friction fit, and with a shoulder 68*f* of the connector abutting the rearward edge of rib 67*a* as seen in FIGS. 4 and 5. Similar shoulders at the ends of the connector 68 also abut posts 67*b* and 67*c*. The spring clips 66 are U-shaped, having their rear legs anchored to the plate 64 as by screws or the like and their forward vertical legs extending downward into a relatively wide shallow recess 66*r* (see FIGS. 4 and 5) which permits limited forward and rearward spring movement of the forward legs. The spring clips 66 are appropriately located to engage the adjacent edge of a connector 68 and to force the connector forward against the element 67 for precise location of the connector 68 on the plate 64.

As above noted, the shaft 63 is journaled at its opposite ends in side plates 98*a* and 98*b* of a chair-shaped base 99 which receives and supports the plate 64. Set screws 65 lock the plate 64 to the shaft 63 (see FIGS. 3 and 6). The rear portion of plate 64, outward of shaft 63, engages a compression spring 77 disposed in recess 64*a* of plate 64 and in recess 78*a* of an underlying adapter base plate 78. Plate 78 preferably is formed integrally with side plates 98 and 98*a* as illustrated to form chair-like structure 99. A bolt 70 shown in FIG. 6 may be employed for securing the adapter 62 to the plate 40 by threadedly engaging a tapped aperture 72 therein after traversing an enlarged opening 64*b* in the floating plate 64 and an opening 76 in the underlying base or mounting plate 78. The spring 77 urges plate 64 to rotate clockwise on shaft 63 as seen in FIG. 3 such that the bottom of the forward portion of plate 64 is resiliently biased against a cam 84. Thus, the movement of plate 64 about shaft 63, and more particularly the vertical movement of the forward connector support portion, is regulated by the cam 84 which engages the undersurface of plate 64 (see FIGS. 3 through 6).

Cam 84 is of generally cylindrical configuration, with an elongate, flat cam surface 86 aligned with plate 64, and opposite cylindrical ends journaled in the side plates 98*a* and 98*b* (see FIG. 8). The right shaft end may extend beyond the plate 98*a* (a portion of which is of lesser thickness than plate 98*a* as seen in FIG. 8) for engagement with an actuating handle 88 (see FIG. 3). The handle is mounted on a collar 101 secured to the cam end by the screw 101*a*, and collar 101 contains a tapped aperture 105 in which handle 88 is mounted, as seen most clearly in FIG. 8.

When cam flat 86 is disposed uppermost as illustrated in FIGS. 3 and 4 in engagement with the undersurface of plate 64, the floating plate 64 and the connector 68 mounted thereon are disposed in a lowered position. Upon rotating the cam 84 by means of the handle 88, the cylindrical periphery of the cam 84 will raise the front portion of the floating plate 64 and the connector 68 mounted thereon relative to the overlying wires 16 so that the wires are positioned between the upper portions of channel-defining ribs 68*a* of the connector 68 as illustrated in FIGS. 5 and 9. FIGS. 4 and 5 illustrate the relative disposition between the wires and connector prior to and after rotating cam 84 in the manner above described. Thus, with the floating plate 64 in the raised position, each wire 16 is disposed within the respective terminal recess 68*c* of the connector 68, in position to be driven into jaws 68*e* of a terminal element 68*d* therein, as illustrated in part in FIGS. 9 and 10.

A tool-holding cover plate 90 is mounted on a shaft 91 also journaled at its opposite ends in the side walls 98*a* and 98*b* of the adapter 62 (see FIGS. 3 and 7), The cover plate 90 is moved between a raised position and a lowered position by a handle 92 which may be threadedly anchored in said plate (see FIGS. 1, 3, 6, 7 and 8). In the lowered position of FIG. 6, spaced ram blades 94 of a ram unit 96 (see FIGS. 1 and 8) mounted on plate 90 engage the wires in the wire-receiving channels of the connector 68.

A manually-operated cam and lever mechanism is provided for forcing plate 90 downward to drive the ram blades 94 against the wires in the terminal recesses of the connector 68 and thereby to force the wires downward into the respective terminal bodies 68*d*. Specifically, the cam and lever mechanism includes a cam 102 extending from a shaft 103 which is journaled in a C-shaped arm 100, as is more clearly seen in FIG. 8. The arm 100 is freely rotatably mounted on a right end portion of elevating cam shaft 84, between adapter side wall 98*a* and cam collar 101. A cam actuating handle 104 is attached to shaft 103, preferably being of a weight and attached in a manner to automatically pivot the arm 100 forward by the weight of handle 104 when the handle is forward as in FIG. 3, and to cause the arm to pivot rearwardly as in FIG. 6 when the handle is moved rearwardly by the operator toward the position of FIG. 7. In the rearward position of arm 100 as in FIG. 6, the cam 102 is disposed in vertical alignment with a cooperative bearing surface 106 *a* of a bearing pad 106 mounted on cover plate 90, to drive the plate 90 and blades 94 downward toward elevated plate 64 upon rotation of shaft 103 in a counterclockwise direction from the position of FIG. 6 to the position of FIG. 7.

Figure 6:
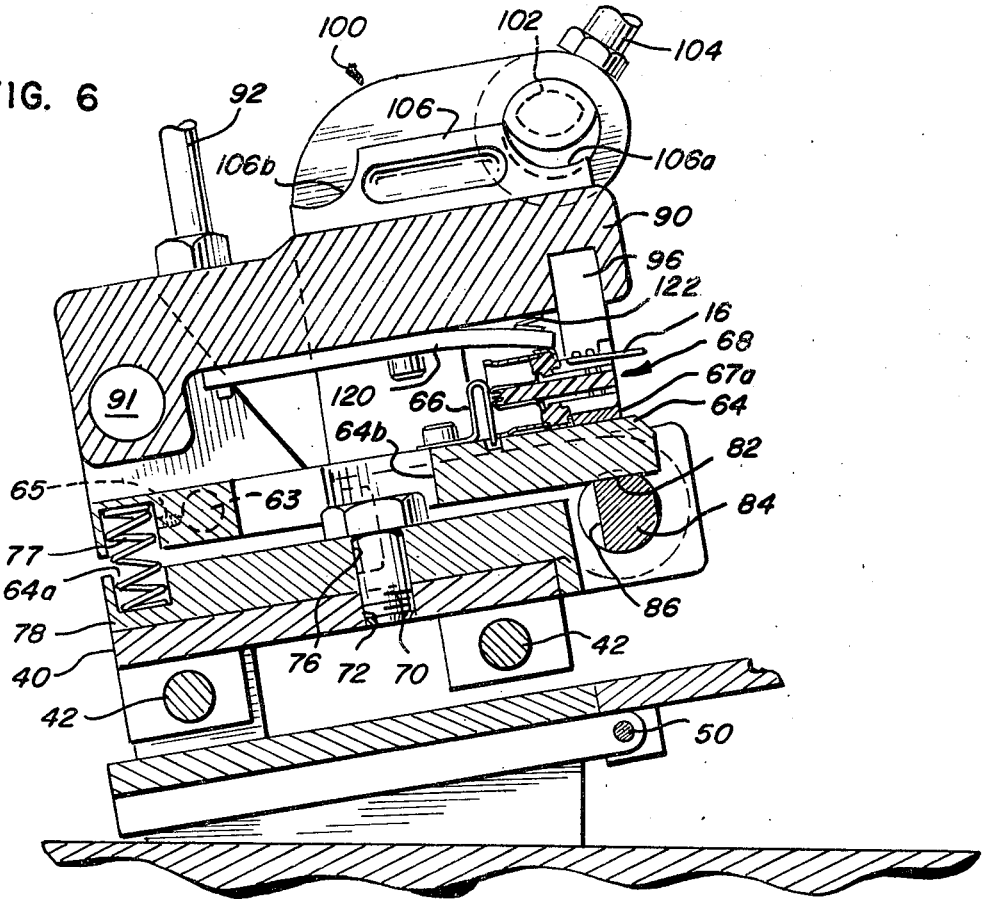
FIG. 6 is a view similar to FIG. 3 with the ram plate and related mechanism in position for final seating of the wires in a connector.

To permit plate 90 to be lowered from the open position of FIG. 3 to the drive position of FIG. 6, the C-frame 100 must be positioned forwardly away from the cover 90 as in FIG. 3. A detent 107 of the C-frame element engages a stop pin 108 (see FIG. 3) at the end limit of such forward rotational movement of arm 100 and in this position allows the plate 90 to move over floating plate 64 and assume the position illustrated in FIG. 6. In the latter position the cover 90 and more particularly the ram blades 94 therein engage and rest atop the wires 16 disposed in the recesses 68*c*. If no connector is disposed on plate 64 cover 90 may pivot well below the horizontal until the blades 94 engage the element 67.

With cover 90 in the position of FIG. 6, the C-frame element 100 is moved from the forward position of FIG. 3 rearwardly over cover 90, until stop surface 108*a* of detent 107 engages stop pin 108. The C-frame 100 is then in the position of FIG. 6 with cam 102 juxtaposed with the arcuate bearing surface 106*a* of bearing pad 106. Thereafter, rotation of lever 104 counterclockwise as viewed in FIG. 6 drives the ram blades 94 downwardly into the connector channels 68*c* until the wires 16 are firmly seated in terminal bodies 68*d* and gripped in metal-to-metal contact by the connector jaws 68*e* as illustrated in FIG. 10. The end portions of the ram blades are narrow in width to so enter the channels or recesses 68*c*, and are formed with notches and relieved portions at their distal ends as shown to avoid damaging contact with the jaws 68*e* and strain relief tabs of the connector bodies 68*d* during the wire seating operation, as discussed in greater detail in the aforementioned application Ser. No. 502,086.

The height of the operative bearing surface of pad 106 determines the distance the blades 94 are driven downwardly into the connector channels by the cam 102. Alternate surface 106*b* of bearing pad 106 may be readily moved into operative position for engagement with cam 102 by raising pad 106 in opposition to spring 111 disposed about centering pin 110 anchored in pad 106 (see FIG. 7) and rotating the pad 180° so that pad locating apertures 113 again engage locating pins 115 mounted in plate 90. The two surfaces 106*a* and 106*b* of pad 106 are of different heights, to ensure proper seating of the wires in connectors of various terminal channel depths mounted on floating plate 64, such as the variations between male and female connectors 68 and between connectors of various manufacturers.

For precise adjustments of the unit 96 comprising the ram blades 94, abutment screws 117 are adjustably located in plate 90 as seen in FIG. 8. Support screws 119 which threadedly engage blade unit 96 at opposed ends are similarly located in plate 90 to draw the unit 96 against the screws 117. The adjustability of unit 96 and ram blades 94 thereof relative to cover 90 may be readily and accurately carried out by loosening of screws 119, re-adjustment of abutment screws 117 and resecuring screws 119.

In order to efficiently strip the connector 68 from the interfitting ram blades 94 following a termination of wires in the connector, a stripper blade 120 (see FIGS. 3, 6 and 7) secured to the undersurface of cover 90 adjacent ram unit 96 is employed. As the unit 96 and blades 94 are driven downwardly by cam-actuating lever arm 104, the free distal end of blade 110 is urged upwardly, simultaneously compressing coil spring 122. During subsequent raising of cover 90 after C-frame 100 and cam 102 mounted thereon have been pivoted out of engagement with pad 106, stripper blade 120 is urged outwardly by coil spring 122, thereby, stripping connector 68 from the ram blades 94.

Cam actuating handle 104 is attached by engaging a tapped aperture 124 in a collar 126 attached to the outer end of cam shaft 103, see FIG. 8. The collar 124 is removable and is secured to the shaft 103 by a key or the like. The collar 124 and a flange 128 adjacent the cam 102 axially maintain the shaft 103 in position in the arm 100. The inner peripheral portion of collar 126 may be cut away as at 130, see FIG. 8, so as to define steps on the collar periphery to engage a stop pin (not illustrated) to define the permissible rotation of the cam shaft 103.

The provided apparatus is thus employed to interengage connector channels and a plurality of wires to be terminated by gripping jaws of solderless terminals in those channels. The engagement step is effected substantially instantaneously by mere rotation of the cam-actuating lever without the necessity of time-consuming and tedious manipulative steps of placing each wire in its desired connector channel.

The method of operation embodied in apparatus 10 is believed to be clear from the foregoing. However, in summary, the color-coded wires 16 to be terminated are first strung out over the comb, clamp base, shear plate and wire retention means in the desired order of wire arrangement to be assumed in the connector when terminated therein. Following the effecting of desired wire alignment, and cutting of the wires to exact, desired length, the trimmed wires are positioned in registry with numbered channels of a connector. The connector is then moved normal to the longitudinal axes of the wires, such that the wires enter the connector recesses in a direction of relative motion generally normal to the wire axes. The wires are captured between the recess or channel defining ribs. Such "captured" condition is readily visible to the operator and insures desired location of the wires in the connector prior to positioning of the tool-holding cover and ram blades mounted therein over the wires and connector. Thereafter the wires are driven downwardly simultaneously by the individual drive blades into electrical contact with the respective terminal jaws. The registry of each wire in the respective recess insures confinement and guiding of each wire for proper engagement and driving of the wires by the respective blade during the driving and seating operation without any other wire capturing or guiding mechanism.

It will be seen that wire termination apparatus and methods have been provided which meet the aforestated objects of this invention.

While there has been shown and described a preferred embodiment of the present invention, it will be apparent to those skilled in the art that further changes and modifications may be made without departing from the invention in its broader aspects. It is, therefore, contemplated in the appended claims to cover all such changes and modifications as fall within the true spirit and scope of the present invention.

What is claimed is:

1. Apparatus for simultaneously effecting solderless termination of a plurality of wires in a connector of the type having a plurality of terminals with the electrical contact portions of each terminal disposed within a separate terminal recess, comprising first means for supporting a plurality of insulated wires in predetermined, spaced, parallel relation to one another at spacings corresponding to the spacing of such recesses of such a connector, second means for supporting such a connector in a position such that said wires are juxtaposed with said recesses of a connector supported on said second means, means for effecting relation movement between said first and second means in a direction generally normal to the longitudinal axes of said wires and thereby positioning said wires in confinement engagement with said recesses, and means engageable with each of said wires after said wires are so confined in said recesses for forcing each of said wires into electrically conductive engagement with the contact portions of the terminal in the respective recess.

2. The apparatus of claim 1 in which connector locating means are disposed in said second means for precisely positioning a connector supported on said second means, said locating means comprising fixed means engaging peripheral portions of a connector disposed on said second means, and means for resiliently urging a connector disposed on said second means against said fixed means.

3. The apparatus of claim 1 in which said second means comprises a pivotally-mounted plate resiliently biased against a rotatable cam which effects said relative movement in the course of cam rotation.

4. The apparatus of claim 1 in which said means engageable with said wires comprises ram blades positionable over the recesses of a connector when disposed on said second means, and drive means connected to said ram blades and adapted to force said ram blades into said connector recesses whereby said wires are forced into electrical conductive engagement with the contact portions of the terminals disposed in said connector recesses.

5. The apparatus of claim 4 wherein said drive means includes a cover pivotally mounted on a supporting frame and wherein said drive means includes a second rotatable cam operatively engageable with said cover for driving said cover and ram means disposed thereon downwardly into the recesses of a connector when mounted on said second means, in the course of rotation of said second cam.

6. The apparatus of claim 5 in which said second cam engages a bearing pad mounted on said cover, said pad having a plurality of cam-engaging surfaces disposed thereon which are located in operative position by locating means mounted on said cover and engaging said bearing pad, said locating means being adapted to position said pad in a plurality of fixed varying positions on the outer surface of said cover.

7. The apparatus of claim 5 in combination with resilient stripper means mounted on the underside of said cover having a distal end portion positioned so as to be resiliently urged against a connector in the course of said cover being urged toward said second means when a connector is mounted thereon.

8. The apparatus of claim 1 in which said second means is mounted on a sliding support surface by means of a securing means anchored in said sliding support surface and traversing a base portion of said second means.

9. Apparatus for simultaneously effecting solderless termination of a plurality of wires in a connector, the combination comprising a base plate interposed opposed side plates, a connector support plate rotatably mounted over said base plate by means of a shaft journaled at opposed ends in said side plates, resilient means interposed said support plate and said base plate urging said support plate to rotate in one direction, cam means engaging the undersurface of said support plate in opposition to said resilient means and ram means movable in a direction substantially normal to said support plate and removably positionable thereover.

10. The apparatus of claim 9 in which said cam means comprises an elongate cylinder having a flat peripheral portion interposed cylindrical portions journaled in said side plates.

11. The apparatus of claim 9 in which said side plates and base plate are integrally formed.

12. The apparatus of claim 9 in which said ram means comprise projecting spaced ram blades extending from a unitary base portion which is mounted in a cover pivotally movable over said connector support plate, means mounted in said cover securing said ram means thereto and adjustably regulating the distance said ram blades may extend from said cover.

13. The apparatus of claim 12 in combination with second rotatable cam means mounted on a frame element which is pivotally mounted on one end of the cam means engaging the undersurface of said support plate, and a cam-bearing pad mounted on said cover adapted to engage said cam means and drive the ram blades toward said connector support plate upon rotation of said second cam means.

14. Apparatus for simultaneously effecting solderless termination of a plurality of wires in a connector having a plurality of wire-receiving channels, the combination comprising a connector mount for positioning a connector having wire-receiving channels in a precise position in said apparatus; a tool-holding means connected to said mount and movable into overlying relation with said connector mount; spaced ram means mounted on said tool-holding means and overlying wire-receiving channels of a connector disposed on said connector mount in precise superimposed position when said tool-holding means is in such overlying relation to said mount, and means for elevating said connector mount relative to said ram means such that each one of said plurality of wires is in confinement engagement with a respective wire-receiving channel and means for urging said spaced ram means into engagement with said wires and into substantially interfitting engagement with the channels of a connector disposed on said mount after said elevating movement.

15. Apparatus as in claim 14 wherein said tool-holding means is pivotally connected to said mount.

* * * * *

UNITED STATES PATENT OFFICE

CERTIFICATE OF CORRECTION

Patent No. 3,965,558 Dated June 29, 1976

Inventor(s) William H. McKee

It is certified that error appears in the above-identified patent and that said Letters Patent are hereby corrected as shown below:

Column 6, line 3, change the comma (,) to a period (.).

Column 8, line 41, CLAIM 1, "relation" should read -- relative --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,965,558 Dated June 29, 1976

Inventor(s) William H. McKee

It is certified that error appears in the above-identified patent and that said Letters Patent are hereby corrected as shown below:

Column 6, line 3, change the comma (,) to a period (.).

Column 8, line 41, Claim 1, "relation" should read -- relative --.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,965,558 Dated June 29, 1976

Inventor(s) William H. McKee

It is certified that error appears in the above-identified patent and that said Letters Patent are hereby corrected as shown below:

Column 1, lines 42-43, delete "now abandoned".

Column 6, line 3, "," should read -- . --.

Column 8, line 41, "relation" should read -- relative --.

This certificate supersedes Certificate of Correction issued January 25, 1977.

Signed and Sealed this

Third Day of May 1977

[SEAL]

*Attest:*

RUTH C. MASON
*Attesting Officer*

C. MARSHALL DANN
*Commissioner of Patents and Trademarks*